US009772594B2

(12) United States Patent
Hamada

(10) Patent No.: US 9,772,594 B2
(45) Date of Patent: Sep. 26, 2017

(54) CURL CORRECTING DEVICE AND IMAGE FORMING APPARATUS INCLUDING THIS

(71) Applicant: KYOCERA Document Solutions Inc., Osaka (JP)

(72) Inventor: Toshiyuki Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/176,371

(22) Filed: Jun. 8, 2016

(65) Prior Publication Data

US 2016/0370749 A1 Dec. 22, 2016

(30) Foreign Application Priority Data

Jun. 18, 2015 (JP) ..... 2015-122803

(51) Int. Cl.
*G03G 15/00* (2006.01)
*G03G 21/00* (2006.01)
*B41J 11/00* (2006.01)

(52) U.S. Cl.
CPC ..... *G03G 15/6576* (2013.01); *B41J 11/0005* (2013.01); *B65H 2301/51256* (2013.01); *G03G 2215/00662* (2013.01)

(58) Field of Classification Search
CPC ..... B41J 11/0005; B65H 2301/5162; B65H 2301/51256; G03G 15/6576; G03G 2215/00662
See application file for complete search history.

(56) References Cited

U.S. PATENT DOCUMENTS 5,202,737 A * 4/1993 Hollar ..... B65H 5/062 162/271
8,862,047 B2 * 10/2014 Furushige ..... G03G 15/6576 271/188
9,020,412 B2 * 4/2015 Osaki ..... G03G 15/6576 399/406
2001/0024013 A1 * 9/2001 Horikoshi ..... B65H 5/025 271/272
2005/0018029 A1 * 1/2005 Takagi ..... B41J 15/048 347/104

(Continued)

FOREIGN PATENT DOCUMENTS

JP 2011-133794 A 7/2011

*Primary Examiner* — Jill Culler
*Assistant Examiner* — Marissa Ferguson Samreth
(74) *Attorney, Agent, or Firm* — Studebaker & Brackett PC

(57) ABSTRACT

A curl correcting device includes a pair of fixed guides and a change-over guide. The pair of fixed guides composes a curved part of a conveyance path. The change-over guide is provided to be contactable with a sheet from a radial outer side of the curved part. An outer guide includes a pair of side pressing parts and a bulge part. The pair of side pressing parts is formed at both ends in a width direction. The bulge part is formed between the pair of side pressing parts so as to bulge toward the radial outer side of the curved part. The change-over guide is configured to move to a first correcting position when the sheet curled along the conveyance direction is conveyed through the conveyance path and to move to a second correcting position when the sheet curled along the width direction is conveyed through the conveyance path.

8 Claims, 15 Drawing Sheets

(56) References Cited

U.S. PATENT DOCUMENTS

| | | | | |
|---|---|---|---|---|
| 2009/0003912 | A1* | 1/2009 | Nagasaki | G03G 15/6576 399/406 |
| 2010/0086338 | A1* | 4/2010 | Hara | G03G 15/6561 399/406 |
| 2014/0140746 | A1* | 5/2014 | Egawa | G03G 15/6576 399/406 |
| 2016/0355029 | A1* | 12/2016 | Kondo | B41J 2/01 |

* cited by examiner

Related Art

CURL CORRECTING DEVICE AND IMAGE FORMING APPARATUS INCLUDING THIS

INCORPORATION BY REFERENCE

This application is based on and claims the benefit of priority from Japanese Patent application No. 2015-122803 filed on Jun. 18, 2015, the entire contents of which are incorporated herein by reference.

BACKGROUND

The present disclosure relates to a sheet correcting device corrects the curl of the sheet and an image forming apparatus including this.

A sheet of paper on which an image has been formed by an electro-photographic image forming apparatus is often curled (has a curling habit). The sheet curls along a conveyance (discharge) direction (referred to also as a 'regular curl' hereinafter) by being nipped by a fixing unit (fixing nip part), a discharge roller pair and the like. The sheet also curls along a width direction orthogonal to the conveyance direction (referred to also as a 'side curl' hereinafter) by being heated by the fixing unit in a condition in which environmental humidity is high for example (see FIG. 15). If the sheet being side-curled is stacked on a sheet discharge tray, there is a case when a succeeding sheet discharged to the sheet discharge tray pushes out the sheet stacked on the sheet discharge tray. Then, a sheet stacking failure occurs on the sheet discharge tray.

Then, technologies for suppressing the sheet stacking failure are being proposed. For instance, an electro-photographic apparatus includes a plurality of pressing parts at widthwise both sides of a sheet. The plurality of pressing parts presses widthwise both sides of a side-curled sheet against a sheet receiving surface of a sheet discharge tray. This arrangement makes it possible to prevent the sheet stacking failure.

However, because each of the pressing parts of the electro-photographic apparatus described above merely presses the already side-curled sheet against the sheet discharge tray, it is unable to fully correct the side curl of the sheet. That is, each of the pressing parts of the electro-photographic apparatus described above is unable to remove a cause (side curl of sheet) of the stacking failure. Still further, because each of the pressing parts of the electro-photographic apparatus described above forcibly presses the sheet against the sheet discharge tray, there is a problem that a scratch is left on an image formed on the sheet.

SUMMARY

In accordance with an embodiment of the present disclosure, a curl correcting device includes a pair of fixed guides and a change-over guide. The pair of fixed guides composes a curved part of a conveyance path through which a sheet is conveyed while being curved. The change-over guide is provided to be contactable with the sheet being conveyed through the conveyance path from a radial outer side of the curved part. An outer guide composing a radial outer side of the curved part among the pair of fixed guides includes a pair of side pressing parts and a bulge part. The pair of side pressing parts is formed at both ends in a width direction orthogonal to the sheet conveyance direction. The bulge part is formed between the pair of side pressing parts so as to bulge toward the radial outer side of the curved part more than the pair of side pressing parts. The change-over guide is configured to move to a first correcting position set within the bulge part when the sheet curled along the conveyance direction is conveyed through the conveyance path and to move to a second correcting position set on the radial outer side of the curved part more than the first correcting position when the sheet curled along the width direction is conveyed through the conveyance path.

In accordance with an embodiment of the present disclosure, an image forming apparatus includes an image forming part, a fixing unit, a discharge tray and a curl correcting device. The image forming part transfers a toner image onto a sheet to form an image. The fixing unit fixes the toner image on the sheet. The discharge tray is composed as a discharge destination of the sheet which the toner image has been fixed. The curl correcting device is provided between the fixing unit and the discharge tray and corrects a curl of the sheet being conveyed toward the discharge tray. The curl correcting device includes a pair of fixed guides and a change-over guide. The pair of fixed guides composes a curved part of a conveyance path through which the sheet is conveyed while being curved. The change-over guide is provided to be contactable with the sheet being conveyed through the conveyance path from a radial outer side of the curved part. An outer guide composing a radial outer side of the curved part among the pair of fixed guides includes a pair of side pressing parts and a bulge part. The pair of side pressing parts is formed at both ends in a width direction orthogonal to the sheet conveyance direction. The bulge part is formed between the pair of side pressing parts so as to bulge toward the radial outer side of the curved part more than the pair of side pressing parts. The change-over guide is configured to move to a first correcting position set within the bulge part when the sheet curled along the conveyance direction is conveyed through the conveyance path and to move to a second correcting position set on the radial outer side of the curved part more than the first correcting position when the sheet curled along the width direction is conveyed through the conveyance path.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A suitable embodiment of the present disclosure will be described below with reference to the attached drawings. It is noted that the following description will be based on directions indicated in each drawing. It is noted that a term 'conveyance direction' indicates a conveyance direction of a sheet S and a 'width direction' indicates a width direction of the sheet S orthogonal to the conveyance direction. Still further, such terms as 'upstream' and 'downstream' in the following description represent 'upstream', 'downstream' or the like in a conveying direction of a sheet S.

Figure 1:
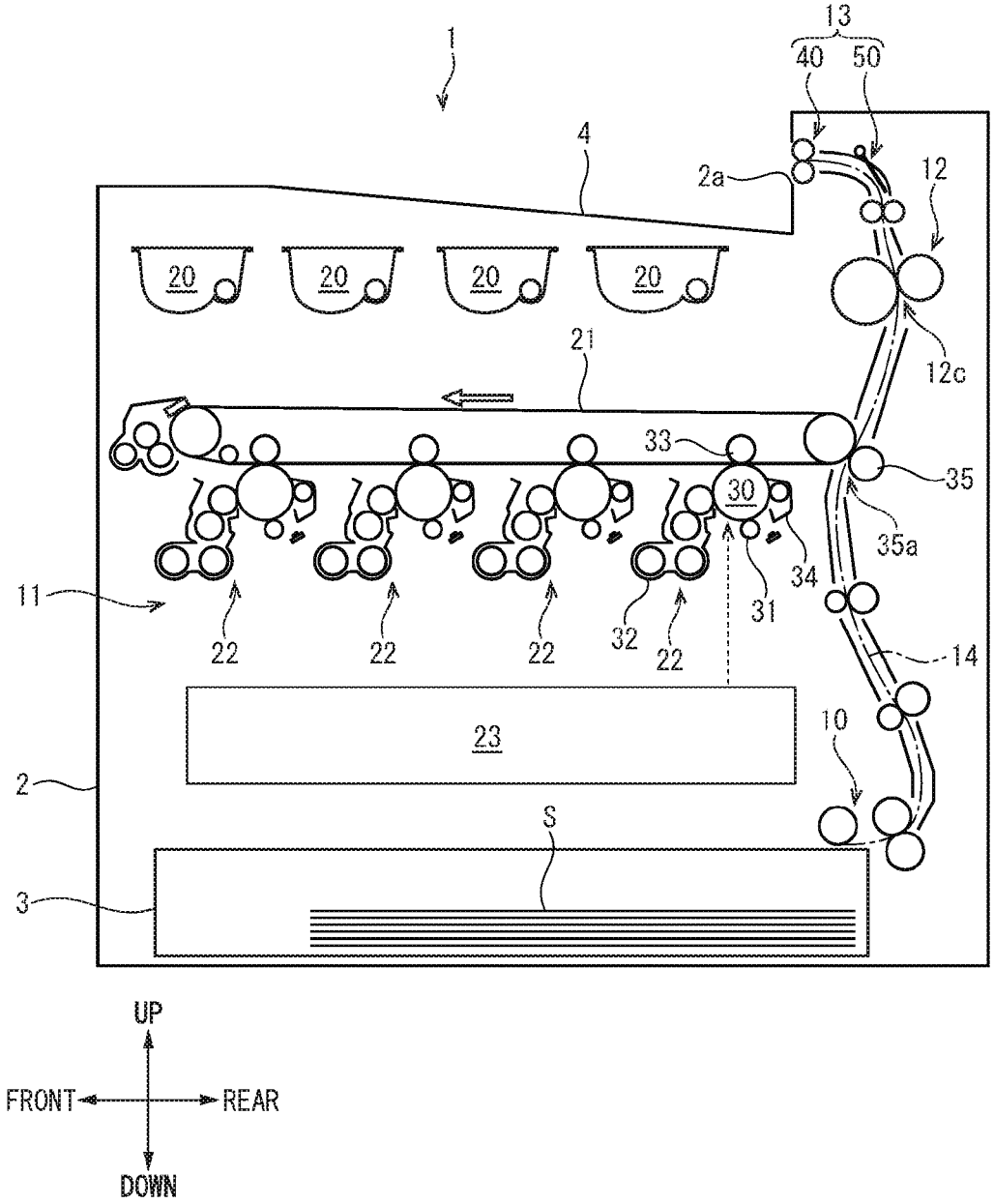
FIG. 1 is a sectional view schematically illustrating a color printer according to a first embodiment of the present disclosure.
Figure 2:
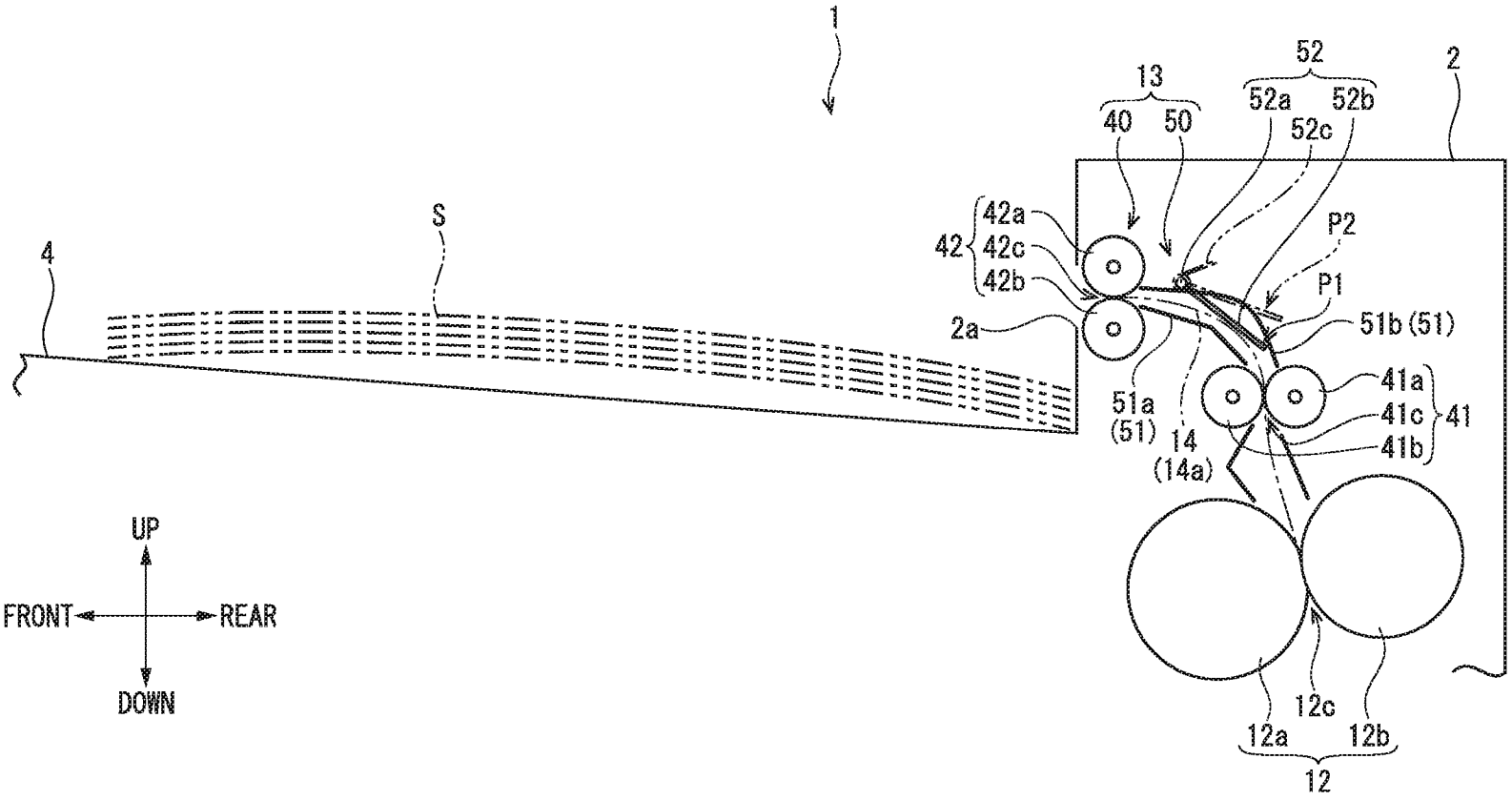
FIG. 2 is a sectional view schematically illustrating a curl correcting device or the like according to a first embodiment of the present disclosure.

With reference to FIGS. 1 and 2, a color printer 1 as an image forming apparatus according to a first embodiment will be described. FIG. 1 is a sectional view schematically showing an inner structure of the color printer 1. FIG. 2 is a sectional view schematically illustrating a curl correcting device or the like.

As shown in FIG. 1, the color printer 1 includes an apparatus body 2, a sheet feed cassette 3 and a discharge tray 4. The sheet feed cassette 3 is provided drawably in a lower part of the roughly box-like formed apparatus body 2. The discharge tray 4 is provided in a upper part of the apparatus body 2. A discharge port 2*a* discharging the sheet S to the discharge tray 4 is opened at an upper part of the apparatus body 2.

A sheet S (bundle of the sheets S) is stored in the sheet feed cassette 3. It is noted that the sheet S is not limited to be a sheet of paper and may be a resin film, and the like. The discharge tray 4 is formed with rising gradient in a direction from the rear side to the front side. The discharge tray 4 is composed as a discharge destination of the sheet S which the toner image has been fixed.

The color printer 1 includes a sheet feeding part 10, an image forming part 11, a fixing unit 12 and a curl correcting device 13 within the apparatus body 2. The sheet feeding part 10 is provided upstream of a conveying path 14 extended from the sheet feed cassette 3 to the discharge tray 4. The image forming part 11 is provided at an intermediate part of the conveying path 14. The fixing unit 12 is provided downstream of the conveying path 14. The curl correcting device 13 is provided downstream along the conveyance path 14 of the fixing unit 12.

The sheet feeding part 10 is configured to separate the sheet S within the sheet feed cassette 3 one by one and to deliver the sheet S to the conveying path 14. The image forming part 11 transfers a toner image onto the sheet S to form an image. The image forming part 11 includes four toner containers 20, an intermediate transfer belt 21, four drum units 22 and an optical scanning device 23. The four toner containers 20 are arrayed in parallel in a front-rear direction under the discharge tray 4. The intermediate transfer belt 21 is disposed under the respective toner containers 20. The four drum units 22 are arrayed in parallel in the front-rear direction under the intermediate transfer belt 21. The optical scanning unit 23 is disposed under the respective drum units 22.

The four toner containers 20 house toners (developing agents) of four colors (yellow, magenta, cyan, black). The four drum units 22 are provided corresponding to the toners of the respective colors. Each of the drum units 22 includes a photosensitive drum 30, a charging device 31, a development device 32, a primary transferring roller 33 and a cleaning device 34. Each drum unit 22 primarily transfers the toner image on the intermediate transfer belt 21. A secondary transfer roller 35 forming a secondary transfer nip part 35*a* is disposed on a right side of the intermediate transfer belt 21. The full-color toner image borne on the intermediate transfer belt 21 is transferred onto the sheet S passing through the secondary transfer roller 35.

As shown in FIG. 2, the fixing unit 12 includes a heat roller 12*a* and a pressure roller 12*b*. The heat roller 12*a* and the pressure roller 12*b* are formed into a cylindrical shape lengthy in a width direction (left-right direction). The heat roller 12*a* is heated by a heater, not shown, provided inside (or outside) thereof. The heat roller 12*a* rotates centering on a shaft by being driven by a driving motor not shown and connected through a gear train and others. The pressure roller 12*b* is biased by an biasing part not shown so as to form a fixing nip part 12*c* with the heat roller 12*a* and to rotate following the heat roller 12*a*. The fixing unit 12 presses and heats the sheet S passing through the fixing nip part 12*c* to fix the toner image on the sheet S. The sheet S which has been fixed is discharged out of a discharge port 2*a* and is placed (stacked) on the discharge tray 4.

The curl correcting device 13 is provided between the fixing unit 12 and the discharge tray 4. The curl correcting device 13 is provided to de curl the sheet S conveyed toward the discharge tray 4 as described later in detail.

Figure 15:
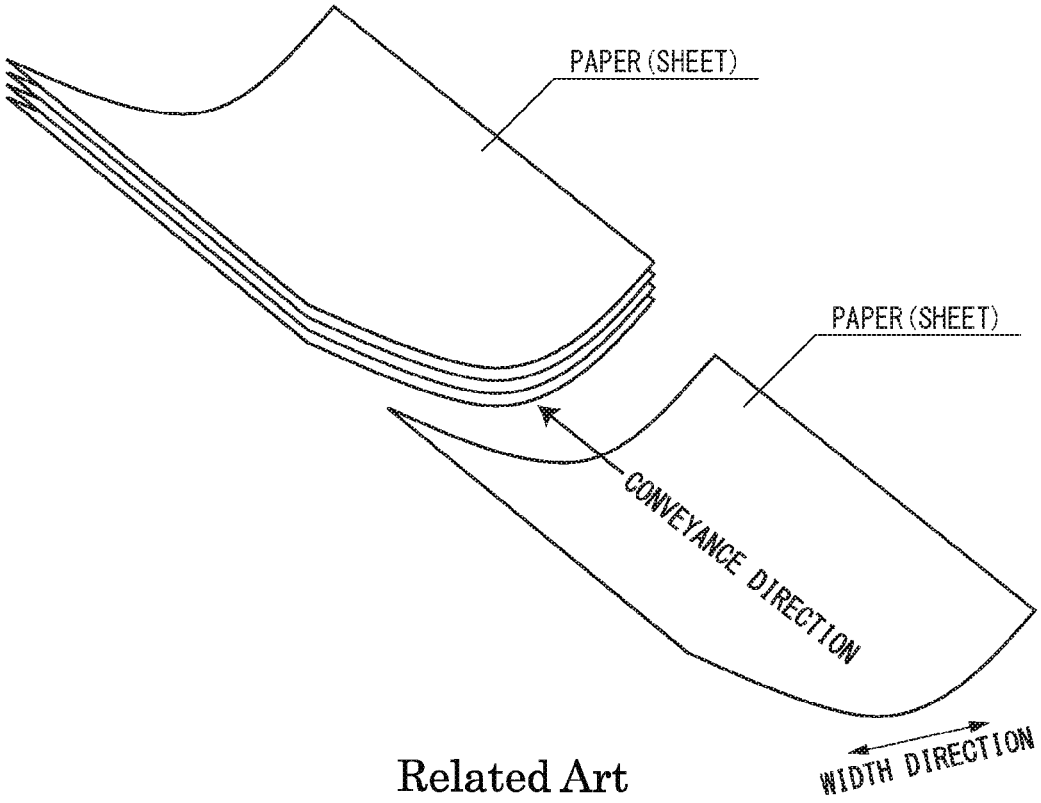
FIG. 15 is a perspective view schematically illustrating a side-curled sheet.

By the way, as shown in FIG. 2, the sheet S is curled (regular curl) along the conveyance direction by being nipped by the fixing unit 12 and others. That is, the sheet S is curled such that a middle part, rather than the both ends in the conveyance direction, bulges upward in a side view. When the regularly curled sheets S are consecutively discharged, they are layered on the discharge tray 4 while being approximately aligned. Meanwhile, if a humid sheet S is heated by the fixing unit 12, it curls (side curl) along the width direction (see FIG. 15). That is, the widthwise both ends of the sheet S are curled back upward in a front view. When the side-curled sheets S are consecutively discharged, there is a case where a succeeding sheet S pushes out the sheet S stacked on the discharge tray 4. That is, stacking failure of the sheet S occurs. Then, the color printer 1 of the first embodiment includes the curl correcting device 13 configured to correct the curl (mainly the side curl) of the sheet S.

Figure 3:
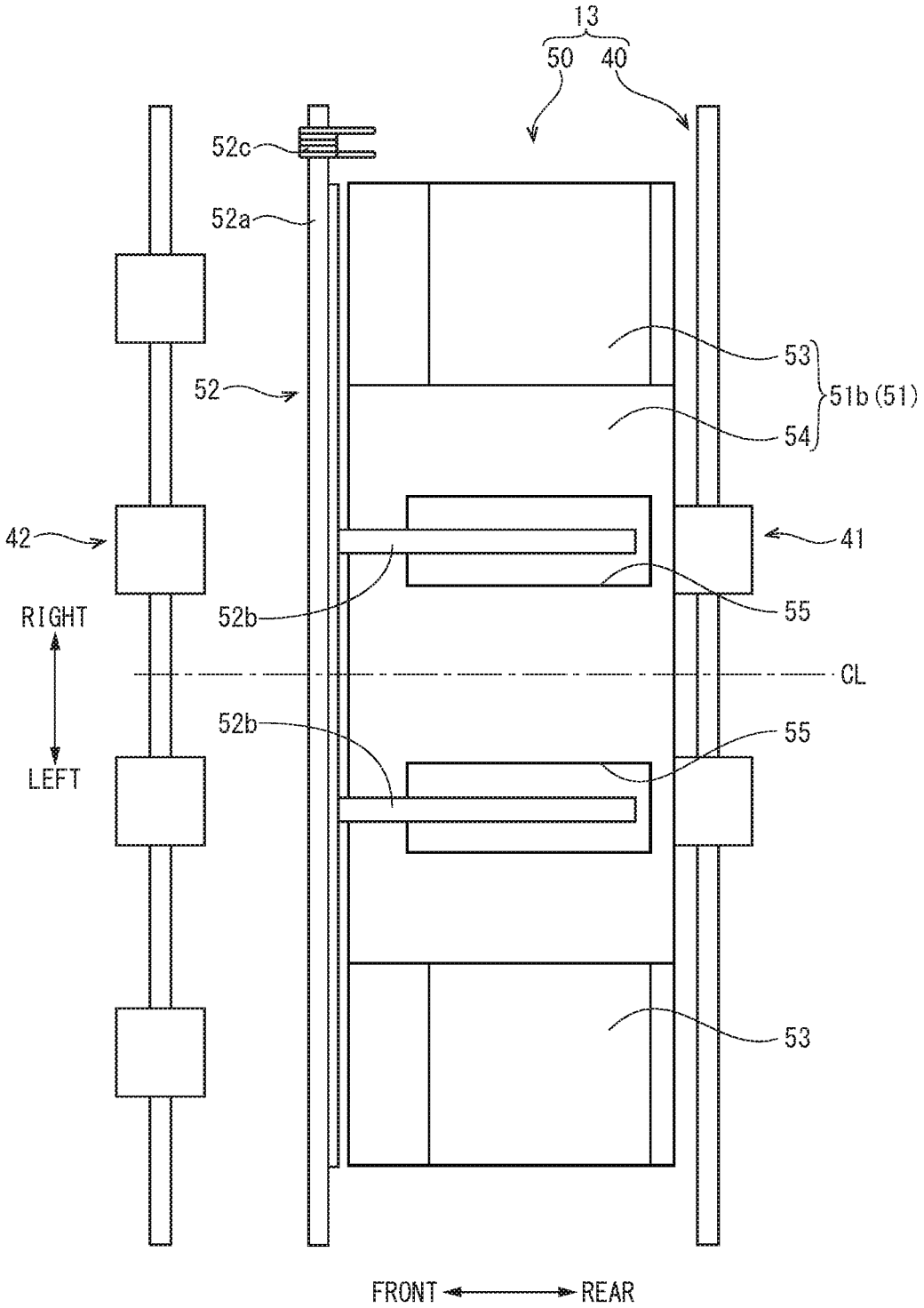
FIG. 3 is a plan view schematically illustrating the curl correcting device according to a first embodiment of the present disclosure.
Figure 4:
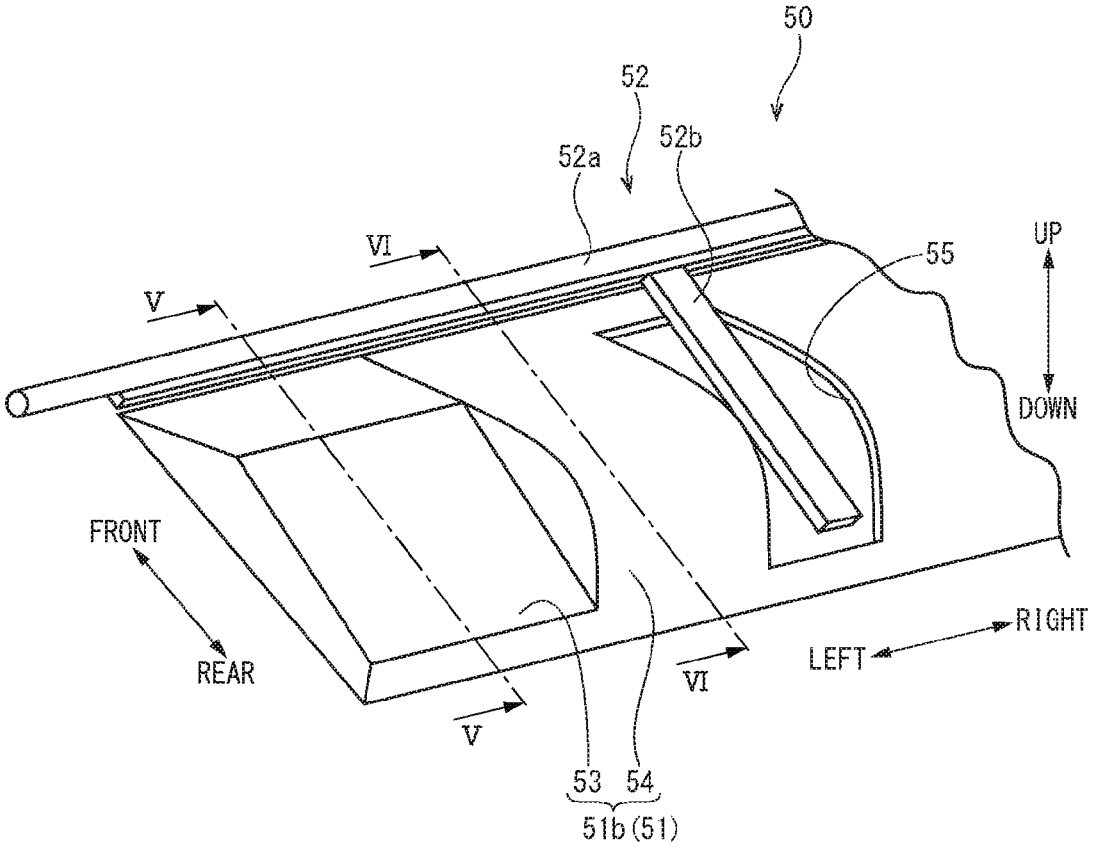
FIG. 4 is a perspective view illustrating the part of the curl correcting device according to a first embodiment of the present disclosure.
Figure 5:
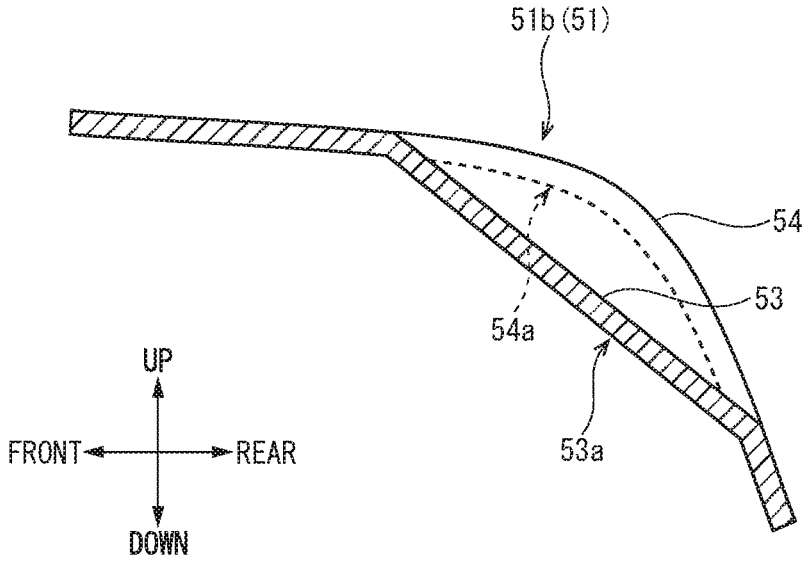
FIG. 5 is a section view taken along a line V-V in FIG. 4.
Figure 6:
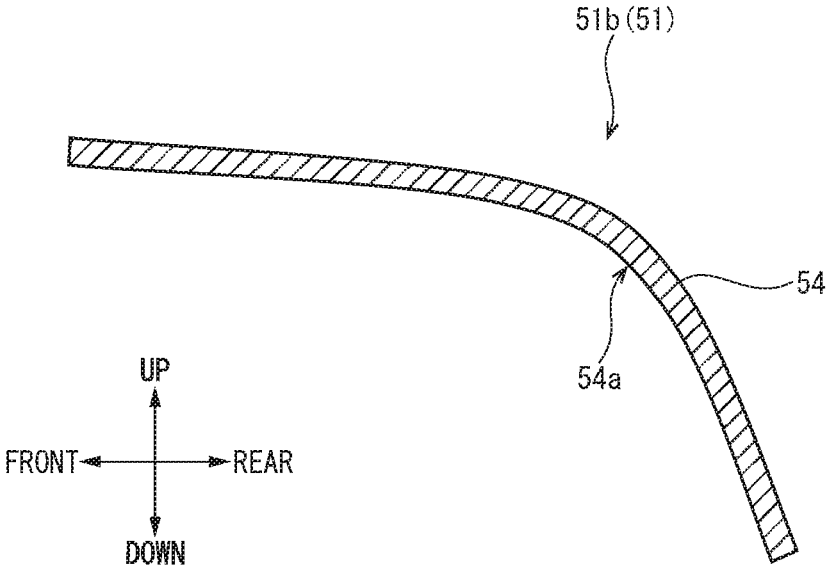
FIG. 6 is a section view taken along a line VI-VI in FIG. 4.

Next, reference to FIGS. 2 through 6, the curl correcting device 13 will be described. FIG. 3 is a plan view schematically illustrating the curl correcting device 13. FIG. 4 is a perspective view illustrating the part of the curl correcting device 13. FIG. 5 is a section view taken along a line V-V in FIG. 4. FIG. 6 is a section view taken along a line VI-VI in FIG. 4.

As shown in FIG. 2, the curl correcting device 13 is provided at a curved part 14*a* formed downstream of the conveyance path 14. It is noted that the curved part 14*a* is formed into an arc shape bent forward gradually along a lower part to an upper part in a side view.

As shown in FIGS. 2 and 3, the curl correcting device 13 includes a discharge part 40 and a correcting part 50. The discharge part 40 conveys the sheet S undergone the fixing process toward the discharge tray 4. The correcting part 50 corrects the curl of the sheet S conveyed by the discharge part 40.

The discharge part 40 includes a first discharge roller pair 41 and a second discharge roller pair 42. The first discharge roller pair 41 is disposed vicinity above the fixing unit 12 (upstream of the curved part 14*a*). The second discharge roller pair 42 is disposed at an inside of the apparatus in a vicinity of the discharge port 2*a* (downstream of the curved part 14*a*).

The first discharge roller pair 41 (discharge roller pair) includes a first driving roller 41*a* and a first driven roller 41*b* in pressure contact with the first driving roller 41*a*. The respective rollers 41*a* and 41*b* are formed into a cylindrical shape lengthy in the width direction (left-right direction). The first driving roller 41*a* rotates centering on a shaft by being driven by a driving motor. The first driven roller 41*b* forms a first nip part 41*c* (nip part) by pressure contact with the first driving roller 41*a*. The first driven roller 41*b* rotates following the first driving roller 41*a*. The first discharge roller pair 41 nips the sheet S at the first nip part 41*c* and feeds the sheet S toward the curved part 14*a* of the conveyance path 14.

Similarly to the first discharge roller pair 41, the second discharge roller pair 42 includes a second driving roller pair 42*a* and a second driven roller pair 42*b* being pressure contact with the second driving roller pair 42 a so as to form a second nip part 42*c*. The second discharge roller pair 42 nips the sheet S at the second nip part 42*c* and feeds the sheet S toward the discharge tray 4. It is noted that because the second discharge roller pair 42 is configured almost in the same manner with the first discharge roller pair 41, a detailed description thereof will be omitted below. It is noted that the respective driving rollers 41*a* and 42*a* to be driven are disposed on radial outer sides of the curved part 14*a*, and the respective driven rollers 41*b* and 42*b* are disposed on radial inner sides of the curved part 14*a*.

The correcting part 50 includes a pair of upper and lower fixed guides 51 and a change-over guide 52. The pair of upper and lower fixed guides 51 composes the curved part 14*a* of the conveyance path 14 through which the sheet S is conveyed while being curved. The change-over guide 52 is provided so as to be contactable with the sheet S being conveyed through the conveyance path 14 from the radial outer side of the curved part 14*a*.

As shown in FIG. 2, the pair of upper and lower fixed guides 51 is fixed within the apparatus body 2 between the two discharge roller pairs 41 and 42. The pair of upper and lower fixed guides 51 is composed of inner guide 51*a* and outer guide 51*b*. The outer guide 51*b* is disposed so as to face an upper side of the inner guide 51*a* across the conveyance path 14 (the curved part 14*a*). That is, the inner guide 51*a* forms the radial inner side of the curved part 14*a* and the outer guide 51*b* forms the radial outer side of the curved part 14*a*.

As shown in FIGS. 3 and 4, the outer guide 51*b* includes a pair of front and rear side pressing parts 53 and a bulge part 54. The pair of front and rear side pressing parts 53 is formed at both widthwise (front-rear direction) end parts of the outer guide 51*b*. The bulge part 54 is formed between the pair of side pressing parts 53 so as to bulge toward the radial outer side of the curved part 14*a* more than the pair of side pressing parts 53.

As shown in FIG. 5, the respective side pressing parts 53 forma guide plane 53*a* with rising gradient from the rear part to the front part of the conveyance path in a side view. As shown in FIG. 6, the bulge part 54 forms a guide curved face 54*a* formed into an arc shape bent forward gradually along the lower part to the upper part of the conveyance path in a side view. The guide plane 53*a* is formed under the guide curved face 54*a* in a side view (see FIG. 5).

As shown in FIGS. 3 and 4, a pair of front and rear guide holes 55 is opened through the bulge part 54. The respective guide holes 55 are formed into a rectangular shape lengthy in the conveyance direction (front-rear direction) in a plan view. The pair of front and rear guide holes 55 is formed at positions linearly symmetrical with a widthwise center line CL (see FIG. 3).

As shown in FIGS. 2 through 4, the change-over guide 52 is configured to be able to advance/recede into/from the bulge part 54 (within the conveyance path 14) from the radial outer side of the outer guide 51*b*. The change-over guide 52 includes a rotating shaft 52*a*, a pair of left and right guide pieces 52*b* and a torsion coil spring 52*c*. The rotating shaft 52*a* is disposed above the outer guide 51*b*. The pair of left and right guide pieces 52*b* is provided to be linear symmetrical with the widthwise center line CL (see FIG. 3). The torsion coil spring 52*c*, i.e., an biasing member, is provided so as to be wound around a right end part (or a left end part or both end parts) of the rotating shaft 52*a*.

The rotating shaft 52*a* is formed into a shape of a bar extending in the front-rear direction and is rotatably supported by the apparatus body 2. The rotating shaft 52*a* is provided downstream of the conveyance path 14 (the curved part 14*a*) extending so as to curve from the first nip part 41*c* of the first discharge roller pair 41 (see FIG. 2). More specifically, the rotating shaft 52*a* is disposed downstream (front side) of the respective guide holes 55 of the outer guide 51*b* (see FIG. 3).

The pair of left and right guide pieces 52*b* is formed approximately into a shape of a bar extending upstream from the rotating shaft 52*a*, respectively. The pair of left and right guide pieces 52*b* is integrally formed with the rotating shaft 52*a* at a position corresponding to the respective guide holes 55 of the outer guide 51*b*. The pair of left and right guide pieces 52*b* penetrates through the corresponding guide holes 55 and extends from the rotating shaft 52*a* toward the first nip part 41*c*. More specifically, the respective guide pieces 52*b* extend to the rear side beyond a vertical line VL passing through the first nip part 41*c* (see FIG. 7). A tip part of each guide piece 52*b* is located in vicinity above the first driving roller 41*a*.

The respective guide pieces 52*b* are turnably provided centering on the rotating shaft 52*a*. The respective guide pieces 52*b* are configured to move between a first correcting position P1 and a second correcting position P2 (see FIG. 2). While a detailed description will be made later, the respective guide pieces 52*b* are configured to move to the first correcting position P1 set within the bulge part 54 when the regularly curled sheet S is conveyed through the conveyance path 14. Still further, the respective guide pieces 52*b* are configured to move to the second correcting position P2 set on the radially outer side (upper side) of the curved part 14*a* more than the first correcting position P1 when the side-curled sheet S is conveyed through the conveyance path 14.

The torsion coil spring 52*c* applies a rotational force to the rotating shaft 52*a* such that each guide piece 52*b* is biased toward the first correcting position P1. That is, each guide piece 52*b* is always biased toward the first correcting position P1. A biasing force of the torsion coil spring 52*c* is set so as to restrict the turn of each guide piece 52*b* when the sheet S fed by the first discharge roller pair 41 pushes the rotating shaft 52*a* side rather than a center in a lengthwise direction of each guide piece 52*b*.

Figure 7:
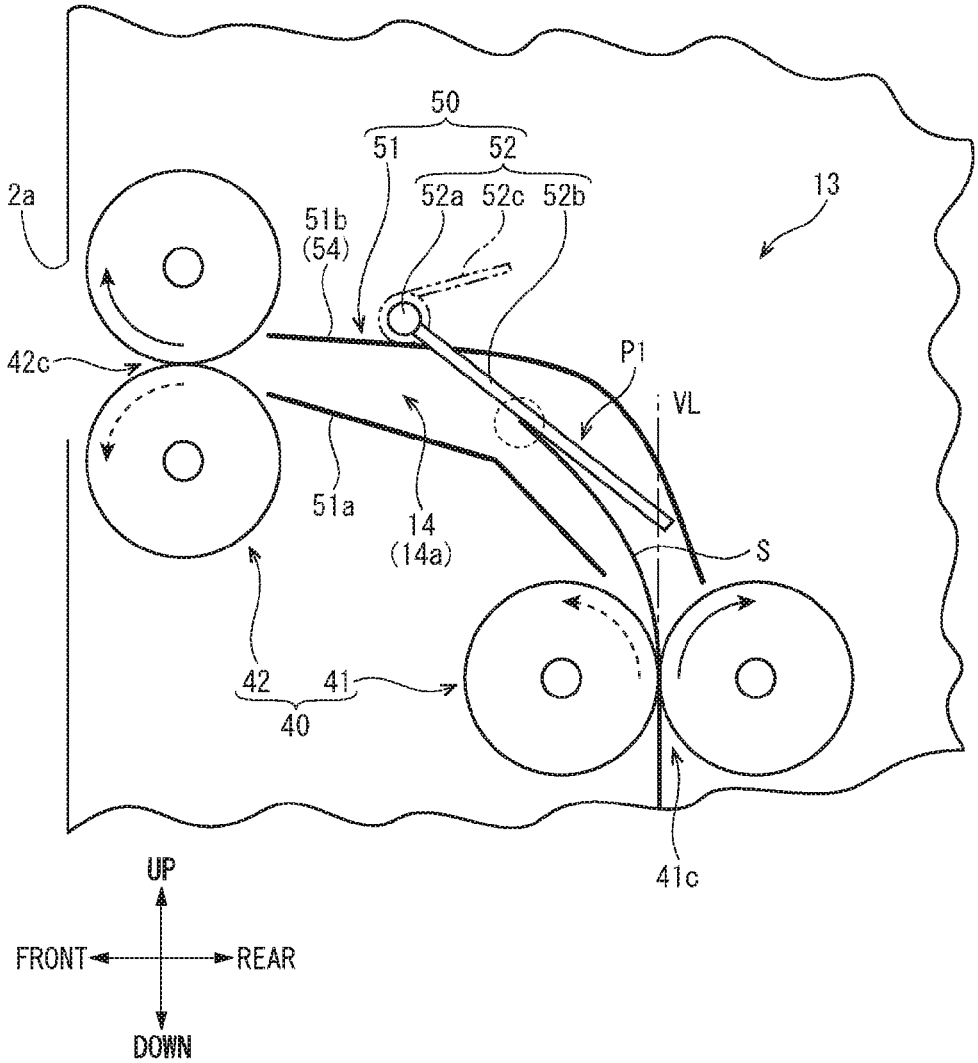
FIG. 7 is a section view illustrating a case where the curl correcting device of the first embodiment of the present disclosure decurls a regularly curled sheet.
Figure 8:
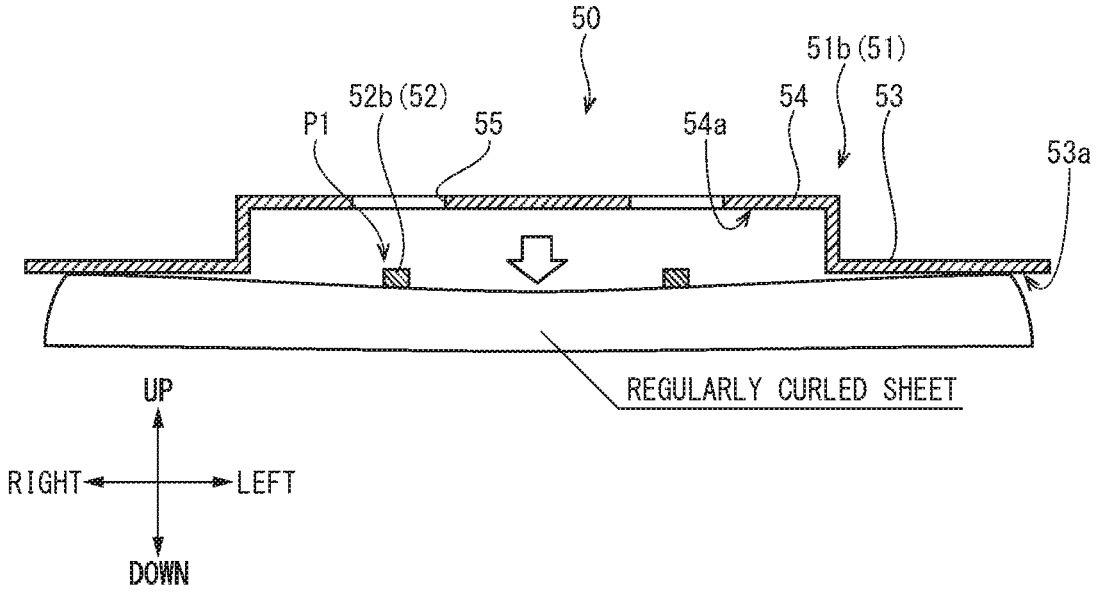
FIG. 8 is a front view illustrating a case where the curl correcting device of the first embodiment of the present disclosure decurls a regularly curled sheet.
Figure 9:
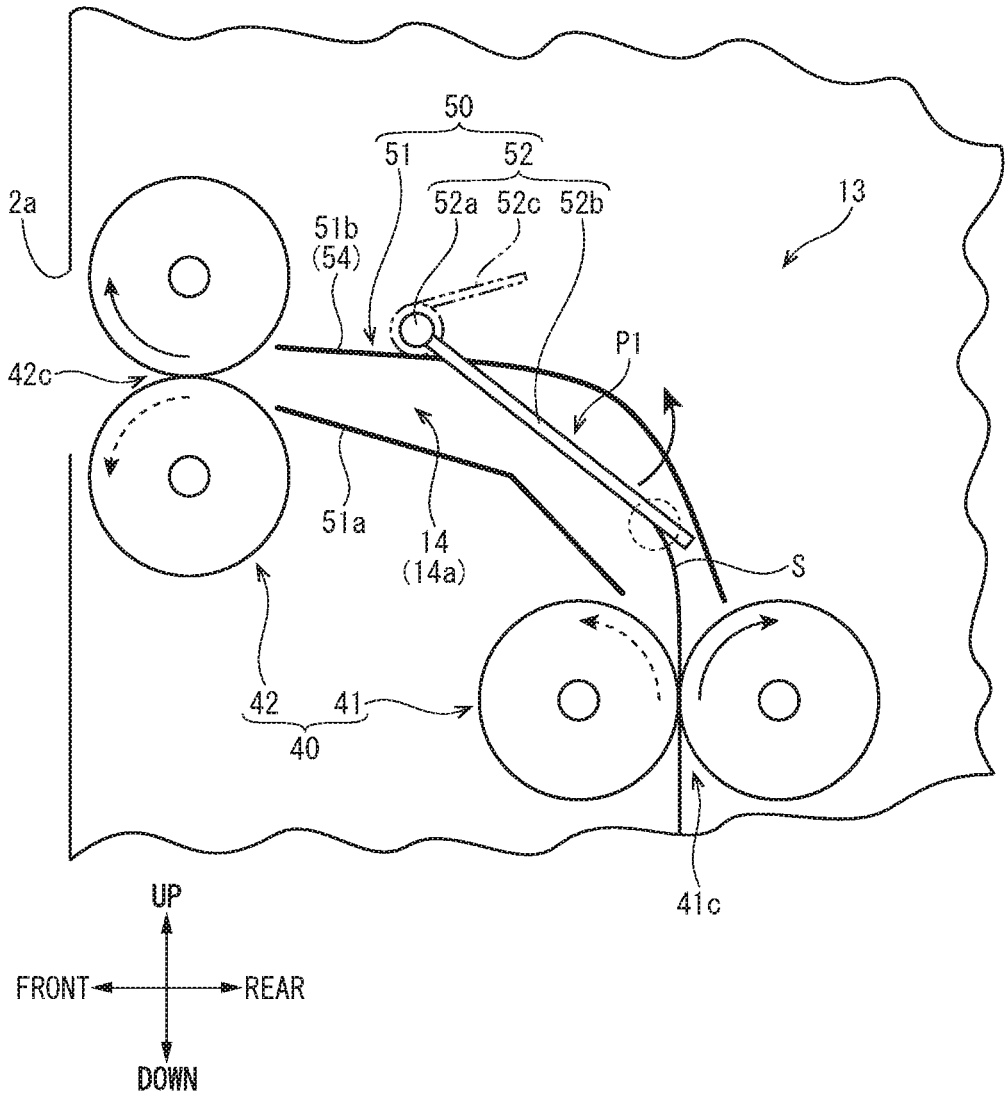
FIG. 9 is a section view illustrating a state in which a side-curled sheet is introduced to the curl correcting device of the first embodiment of the present disclosure.
Figure 10:
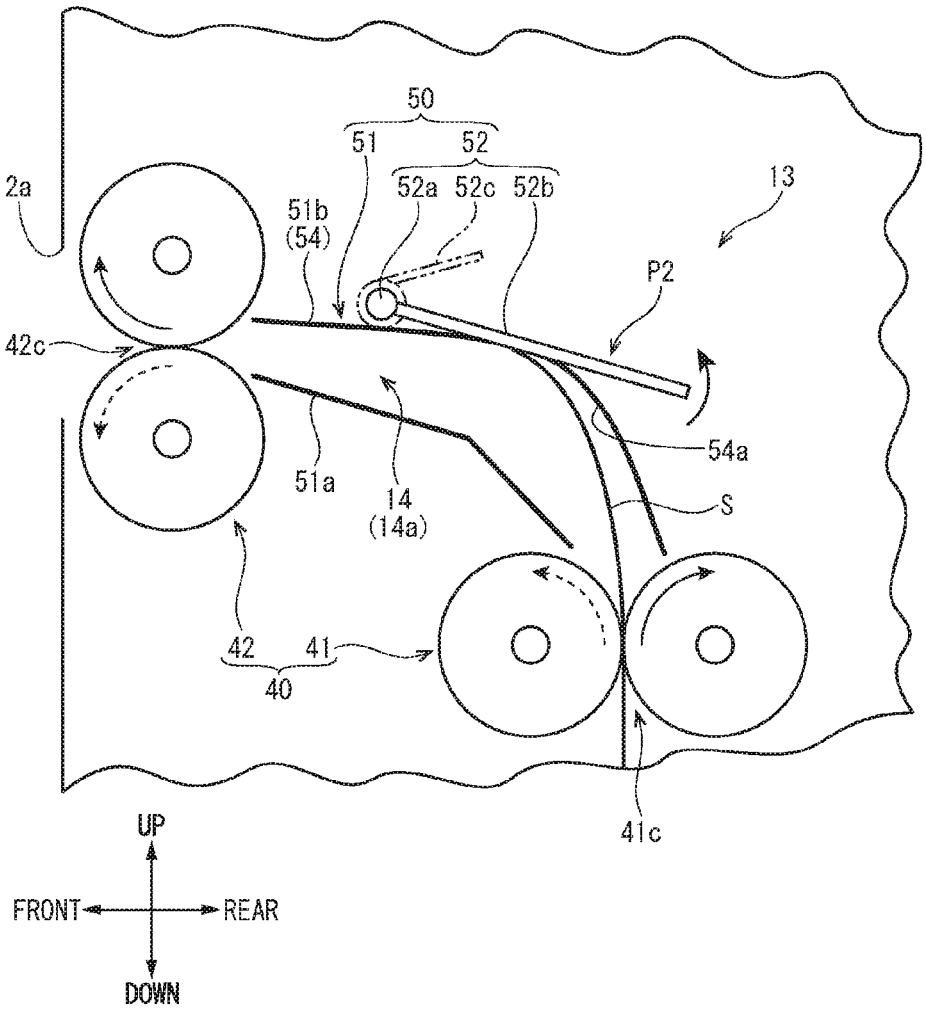
FIG. 10 is a section view illustrating a case where the curl correcting device of the first embodiment of the present disclosure decurls a side-curled sheet.
Figure 11:
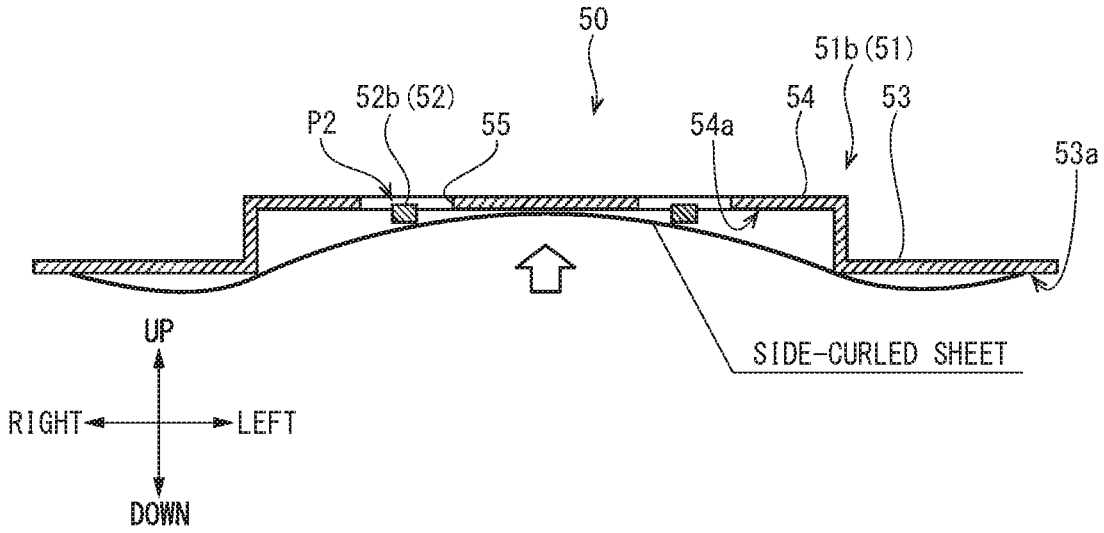
FIG. 11 is a front view illustrating a case where the curl correcting device of the first embodiment of the present disclosure decurls a side-curled sheet.

Next, reference to FIGS. 7 through 11, an operation of the curl correcting device 13 will be described. FIG. 7 is a section view illustrating a case where the curl correcting device 13 decurls a regularly curled sheet S. FIG. 8 is a front view illustrating a case where the curl correcting device 13 decurls a regularly curled sheet S. FIG. 9 is a section view illustrating a state in which a side-curled sheet S is introduced to the curl correcting device 13. FIG. 10 is a section view illustrating a case where the curl correcting device 13 decurls a side-curled sheet S. FIG. 11 is a front view illustrating a case where the curl correcting device 13 decurls a side-curled sheet S.

As shown in FIG. 7, the sheet S which has undergone the fixing process passes through the first nip part 41*c* of the first discharge roller pair 41 and enters the curved part 14*a* of the conveyance path 14. The sheet S passing through the curved part 14*a* is conveyed along the radial outer side (the outer guide 51*b* side) of the curved part 14*a* by its own stiffness. Still further, the sheet S fed by the first discharge roller pair 41 abuts against the respective guide pieces 52*b* of the change-over guide 52.

Here, if the sheet S fed by the first discharge roller pair 41 is curled regularly, the sheet S abuts against the rotating shaft 52*a* side rather than the center in the lengthwise direction of the respective guide pieces 52*b* (see a broken line circle in FIG. 7). Because the regularly curled sheet S abuts against the rotating shaft 52*a* side of the respective guide pieces 52*b*, it is unable to turn the respective guide pieces 52*b* by resisting against the biasing force of the torsion coil spring 52*c*. That is, the respective guide pieces 52*b* are held at the first correcting position P1.

As shown in FIG. 8, an under surface of each guide piece 52*b* displaced to the first correcting position P1 is located at a level lower than the guide plane 53*a* of the respective side pressing parts 53 (radial inner side of the curved part 14*a*) in a side view. The regularly curled sheet S is conveyed while being in sliding contact with the pair of left and right side pressing parts 53 (the guide plane 53*a*) and the respective guide pieces 52*b* displaced to the first correcting position P1. Because the regularly curried sheet is conveyed in a state in which a widthwise middle part thereof is pressed by the respective guide pieces 52*b* (the change-over guide 52), the widthwise both ends of the sheet S leap relatively. Thereby, the regular curl of the sheet S is corrected.

Meanwhile, as shown in FIG. 9, the side-curled sheet S abuts against a front edge side of the respective guide pieces 52*b* (in the vicinity of the first nip part 41*c*) (see a broken line circle in FIG. 9). Therefore, the respective guide pieces 52*b* turn toward the second correcting position P2 by resisting against the biasing force of the torsion coil spring 52*c* as shown in FIG. 10.

As shown in FIG. 11, the lower surface of the respective guide pieces 52*b* displaced to the second correcting position P2 is located almost at the same level with the guide curved face 54*a* of the bulge part 54 in a side view. Because the side-curled sheet S is conveyed in a condition in which the widthwise both ends are pressed by the pair of left and right side pressing parts 53 (the guide plane 53*a*), the widthwise middle part of the sheet S rises relatively and enters the bulge part 54. That is, the widthwise middle part of the sheet S bulges toward the radial outer side of the curved part 14*a*. Thereby, the side curl of the sheet S is corrected.

As described above, the curl correcting device 13 corrects the curl (regular curl, side curl) of the sheet S generated after passing through the fixing unit 12. The sheet S is decurled while passing through the conveyance path 14 (the curved part 14*a*). The decurled sheet S passes through the second nip part 42*c* of the second discharge roller pair 42 and is discharged by the discharge tray 4 (see FIG. 2). This arrangement makes it possible to prevent stacking failure of the sheets S from occurring because the plurality of sheets S can be stacked, while being aligned, on the discharge tray 4.

As described above, the respective guide pieces 52*b* displaced to the first correcting position P1 correct the regular curl by acting so as to apply a side curl on the sheet S. Meanwhile, the respective guide pieces 52*b* displaced to the second correcting position P2 correct the side curl by acting so as to apply a regular curl on the sheet S. Thus, the curl correcting device 13 of the first embodiment described above can perform the curl correction corresponding to the direction of the curl by displacing the change-over guide 52 (the respective guide pieces 52*b*).

Still further, the curl correcting device 13 of the first embodiment can appropriately correct the regular curl of the sheet S by providing the two guide pieces 52 linear-symmetrically. Still further, because pressure receiving from the sheet S being conveyed is dispersed to the two guide pieces 52*b*, it is possible to prevent scratches from being left on the sheet S.

Figure 12:
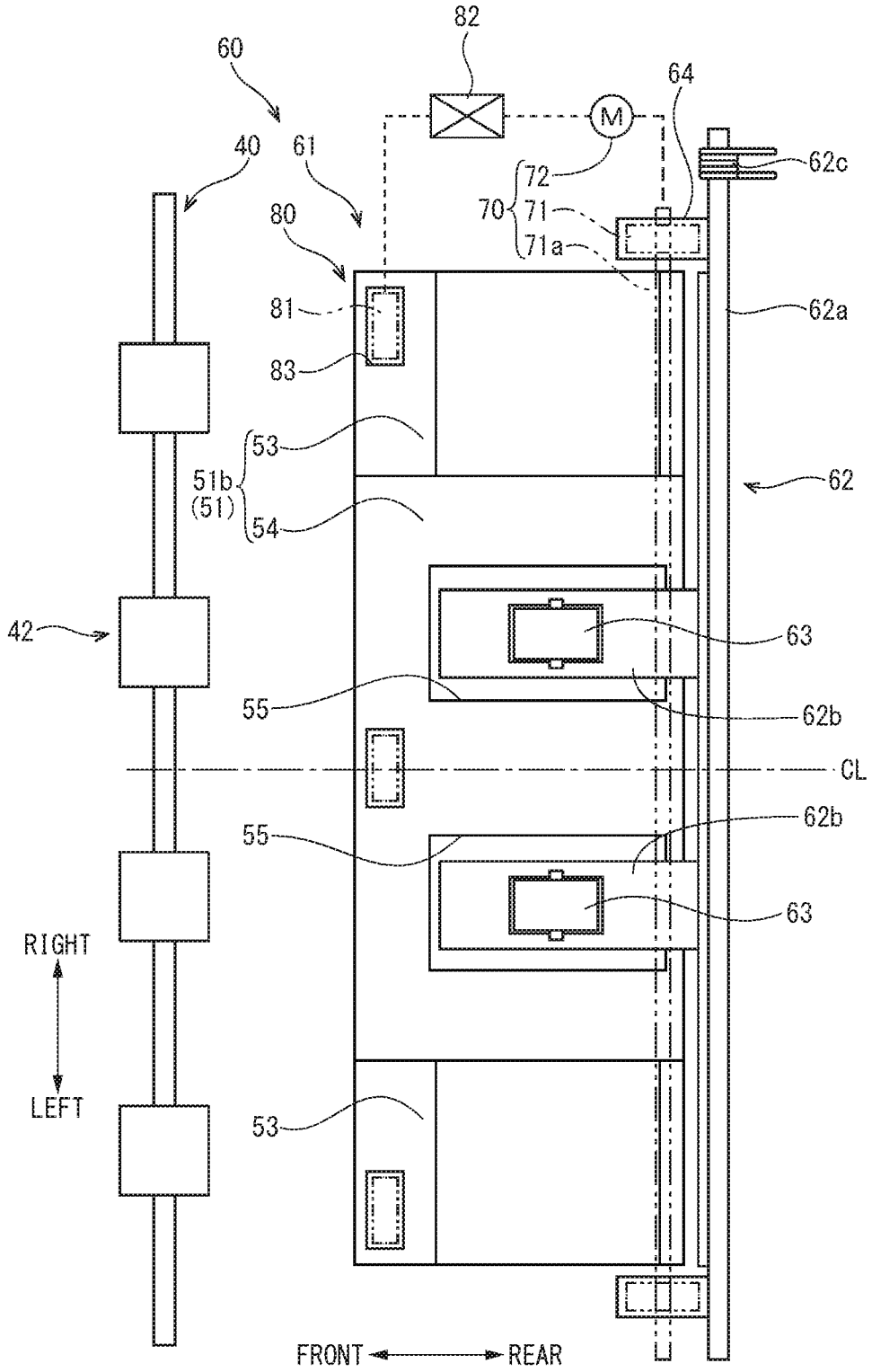
FIG. 12 is a plan view schematically illustrating a curl correcting device according to a second embodiment of the present disclosure.
Figure 13:
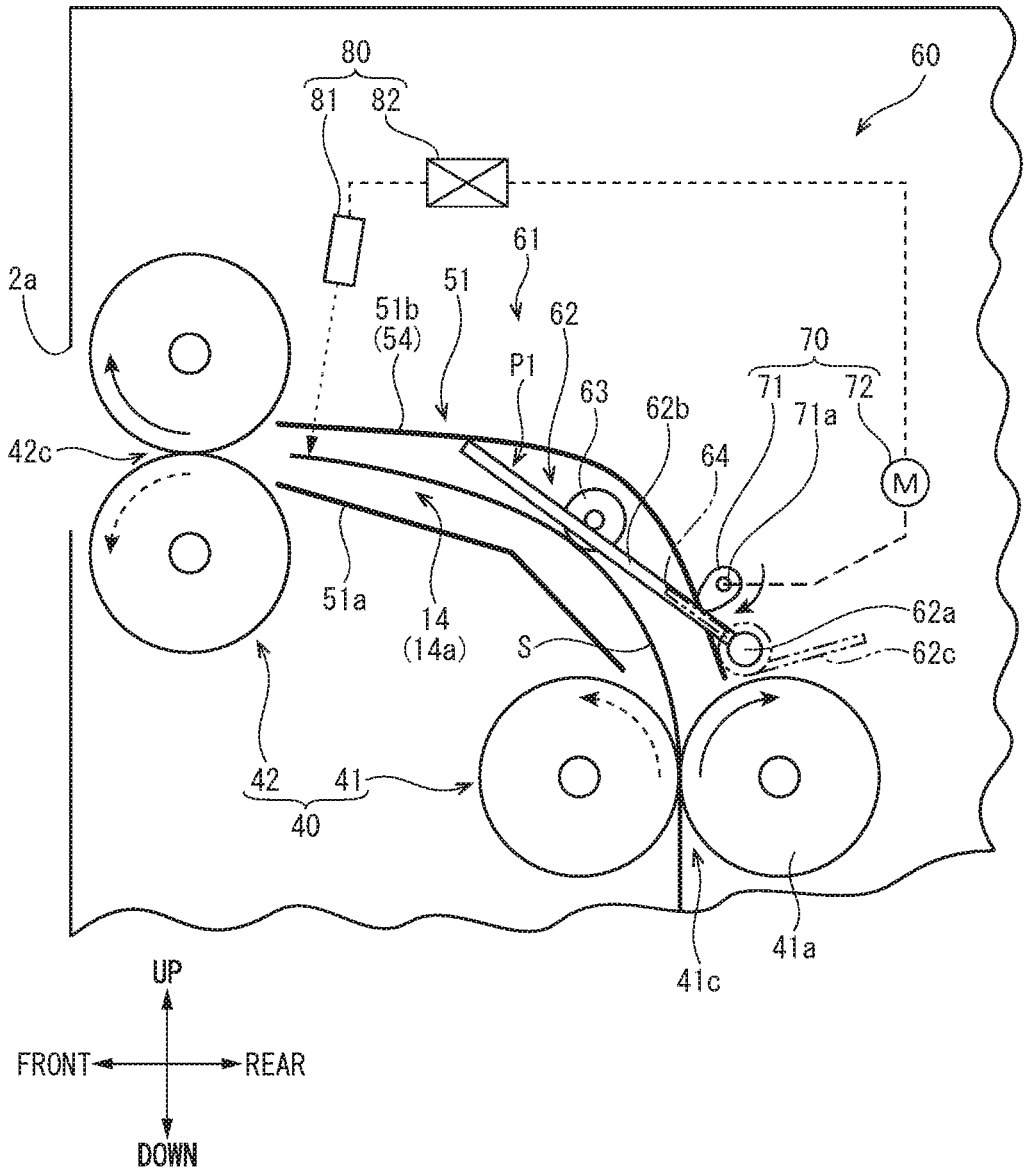
FIG. 13 is a section view illustrating a case where the curl correcting device of the second embodiment of the present disclosure decurls a regularly curled sheet.
Figure 14:
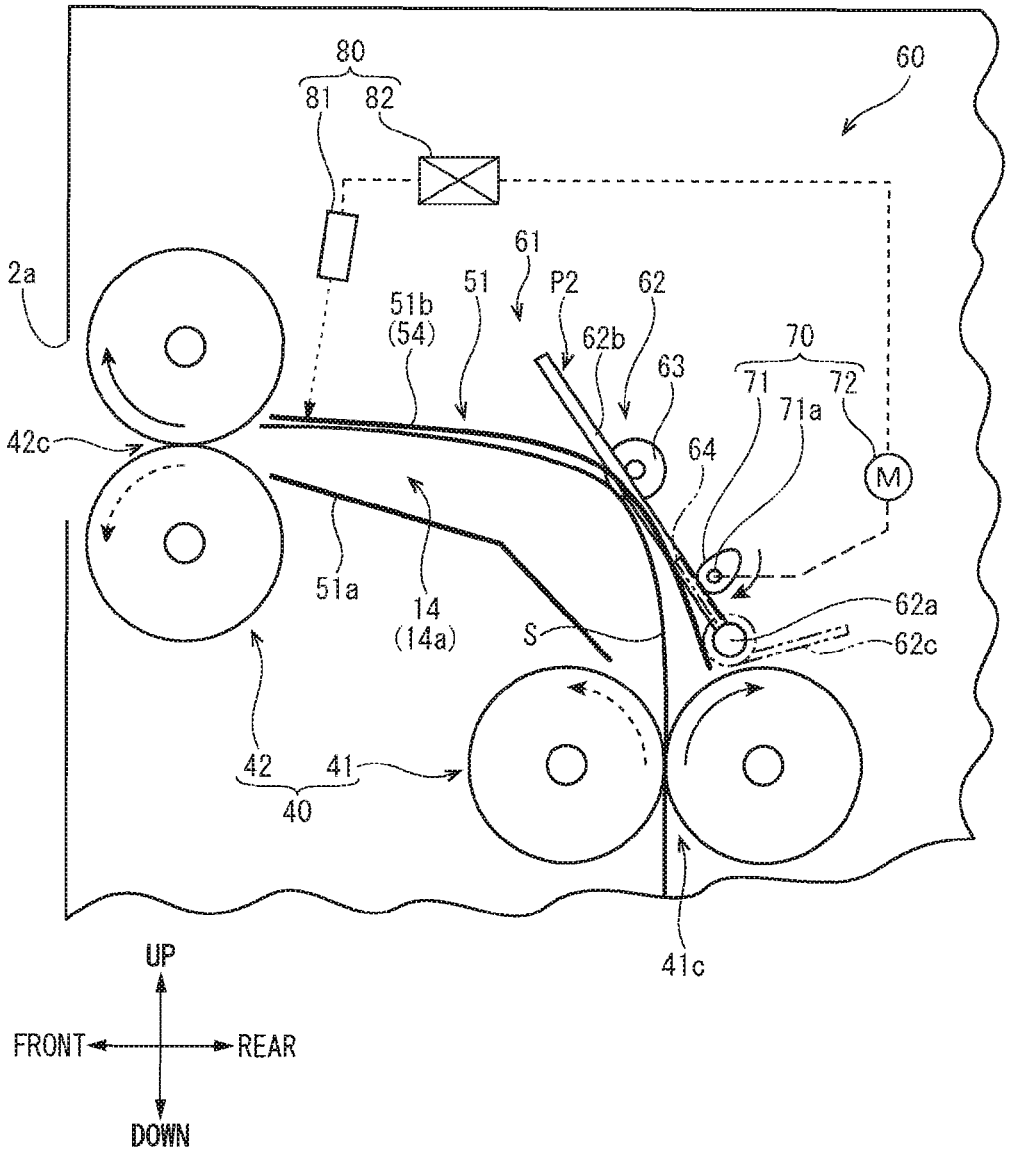
FIG. 14 is a section view illustrating a case where the curl correcting device of the second embodiment of the present disclosure decurls a side-curled sheet.

Next, reference to FIGS. 12 and 14, a curl correcting device 60 according to a second embodiment will be described. FIG. 12 is a plan view schematically illustrating the curl correcting device 60. FIG. 13 is a section view illustrating a case where the curl correcting device 60 decurls a regularly curled sheet S. FIG. 14 is a section view illustrating a case where the curl correcting device 60 decurls a side-curled sheet S. It is noted that in the following description, components of the second embodiment similar to those of the curl correcting device 13 of the first embodiment described above will be denoted by same reference numerals and descriptions thereof will be omitted.

As shown in FIGS. 12 and 13, the curl correcting device 60 includes a discharge part 40, a correcting part 61, a driving part 70 and a detecting part 80.

A change-over guide 62 of the correcting part 61 includes a rotating shaft 62*a*, a pair of left and right guide pieces 62*b*, a torsion coil spring 62*c* and a pair of left and right guide rollers 63.

The rotating shaft 62*a* is provided on the radial outer side of the outer guide 51*b* and vicinity above the first driving roller 41*a* (see FIG. 13). The pair of left and right guide pieces 62*b* is formed approximately into a shape of a plate extending downward from the rotating shaft 62*a*. The pair of left and right guide pieces 62*b* penetrates through corresponding guide holes 55 and extends toward the inside of the bulge part 54, respectively. The respective guide pieces 62*b* are configured to rotate centering on the rotating shaft 62*a* and to move between the first correcting position P1 and the second correcting position P2 (see FIGS. 13 and 14). The torsion coil spring 62*c* is wound around a right end part (or left end part or both end parts) of the rotating shaft 52*a*. The torsion coil spring 62*c* acts a rotational force on the rotating shaft 62*a* so as to urge the respective guide pieces 62*b* toward the second correcting position P2.

The pair of left and right guide rollers 63, i.e., rotators, is supported by the guide pieces 62*b* so as to rotate centering on a shaft extending in the width direction. The respective guide rollers 63 rotate in contact with the sheet S conveyed through the curved part 14*a*.

The driving part 70 includes a pair of left and right change-over cams 71 and a cam motor 72.

The pair of left and right change-over cams 71 is fixed at both left and right end parts of the cam shaft 71*a* disposed in parallel with the rotating shaft 62*a*. The respective change-over cams 71 are so-called eccentric cams and in contact with a cam follower part 64 formed approximately into a shape of a plate and extending downstream from the rotating shaft 62*a*.

The cam motor 72 is composed of a positioning controllable stepping motor or the like for example. The cam motor 72 is connected to a right end part (or a left end part) of the cam shaft 71*a* through a gear train not shown. The respective change-over cams 71 rotate by driving the cam motor 72.

The detecting part 80 includes three sheet detecting sensors 81 and a detection control unit 82.

The respective sheet detecting sensors 81 are noncontact type (optical, ultrasonic, or the like) distance sensor for example. The respective sheet detecting sensors 81 are provided above a downstream end part of the outer guide 51*b* (see FIG. 13). The sheet detecting sensors 81 are disposed at widthwise both end parts and a widthwise center part, respectively, in a plan view. It is noted that three sensor holes 83 are opened at positions corresponding to the respective sheet detecting sensors 81 at the downstream end parts of the outer guide 51*b*. The respective sheet detecting sensors 81 detect a condition of a curl of the sheet S conveyed within the conveyance path 14 through the sensor holes 83.

The detection control unit 82 includes an processing unit and others not shown and executing arithmetic processing in accordance to programs and others stored in a memory. The cam motor 72 and the respective sheet detecting sensors 81 are electrically connected with the detection control unit 82. The detection control unit 82 controls the cam motor 72 (more accurately a power supply not shown which supplies electricity power to the cam motor 72) based on detection results of the respective sheet detecting sensors 81.

Next, reference to FIGS. 13 and 14, an operation (guide displacing operation) of the curl correcting device 60 will be described with. It is noted that for convenience of the description, the respective guide pieces 62*b* are supposed to be displaced to the second correcting position P2.

In the guide displacing operation, the change-over guide 62 moves to the first correcting position P1 when a regularly curled sheet S passes through the conveyance path 14 (see FIG. 13), and the change-over guide 62 moves to the second correcting position P2 when a side-curled sheet S passes through the conveyance path 14 (see FIG. 14). It is noted that the guide displacing operation is executed during a period from a passage of an initial sheet S to a passage of a succeeding sheet S in the curved part 14*a*.

For instance, if the regularly curled sheet S is discharged to the discharge tray 4, the respective sheet detecting sensors 81 transmit signals indicating that the sheet S passed through the conveyance path 14 (the curved part 14*a*) is regularly curled to the detection control unit 82. Receiving detection results of the respective sheet detecting sensors 81, the detection control unit 82 recognizes that the sheet S discharged to the discharge tray 4 is regularly curled.

Under control of the detection control unit 82, the cam motor 72 rotates the respective change-over cams 71 (the cam shaft 71*a*). At this time, the detection control unit 82 controls a rotation angle of the cam motor 72 such that the respective guide pieces 52*b* are displaced to the first correcting position P1. The respective turning change-over cams 71 press the cam follower part 64 while sliding on the cam follower part 64. Thereby, the respective guide pieces 62*b* turn centering on the rotating shaft 62*a* while resisting against a biasing force of the torsion coil spring 62*c* and are displaced from the second correcting position P2 to the first correcting position P1 (see FIG. 13). Then, the regular curl generated on the succeeding sheet S is corrected by the respective guide pieces 62*b* displaced to the first correcting position P1 (see FIG. 13).

Next, if the sheet S generates a side curl, the respective sheet detecting sensors 81 transmit signals indicating that the sheet S passed through the curved part 14*a* is side-curled to the detection control unit 82. Receiving detection results of the respective sheet detecting sensors 81, the detection control unit 82 recognizes that the sheet S discharged to the discharge tray 4 is side-curl.

Under control of the detection control unit 82, the cam motor 72 rotates the respective change-over cams 71 so as to displace the respective guide pieces 62*b* from the first correcting position P1 to the second correcting position P2. The rotating change-over cams 71 release the pressure on the cam follower part 64 while sliding on the cam follower part 64. Thereby, the respective guide pieces 62*b* are turned centering on the rotating shaft 62*a* by the biasing force of the torsion coil spring 62*c* and are displaced from the first correcting position P1 to the second correcting position P2 (see FIG. 14). Then, the side curl generated on the succeeding sheet S is corrected by the respective guide pieces 62*b* displaced to the second correcting position P2 (see FIG. 14).

According to the curl correcting device 60 of the second embodiment described above, the driving part 70 moves the change-over guide 62 (the respective guide pieces 62*b*) based on the detection results of the respective sheet detecting sensors 81. The driving part 70 can adjust a moving amount of the change-over guide 62 (the respective guide pieces 62*b*) corresponding to a condition of the curl detected by the respective sheet detecting sensors 81. This arrangement makes it possible to decurl optimally corresponding to size (radius and others) of the curl.

It is noted that in the guide displacing operation described above, while the respective guide pieces 62*b* are displaced to the two positions (the first and second correcting positions P1 and P2), the present disclosure is not limited to such configuration. For instance, the driving part 70 (the detection control unit 82) may be configured so as to displace the respective guide pieces 62*b* among three or more positions. It is noted that the sheet detecting sensors 81 may be provided by three or more.

The guide rollers 63 pivotally supported by the respective guide pieces 62*b* come into contact with the sheet S passing through the conveyance path 14 (the curved part 14*a*). Because the respective guide rollers 63 rotate on the sheet S, it is possible to assure smooth conveyance of the sheet S and to correct the curl. It is noted that the respective guide rollers 63 may be provided on the respective guide pieces 52*b* of the curl correcting device 13 of the first embodiment.

It is noted that while the guide displacing operation described above is controlled by the detection control unit 82, the present disclosure is not limited to such configuration and a control unit executing the image forming process may function as the detection control unit 82. Still further, the rotating shaft 62*a* of the curl correcting device 60 of the second embodiment is provided upstream of the curved part 14*a*, the present disclosure is not limited such configuration and the rotating shaft 62*a* may be provided downstream of the curved part 14*a*.

It is noted that while one rotating shaft 52*a* (62*a*) and one torsion coil spring 52*c* (62*c*) are commonly used for the two guide pieces 52*b* (62*b*) in the curl correcting device 13 (60) of the first embodiment (the second embodiment), the present disclosure is not limited to such configuration. For instance, the rotating shaft 52*a* (62*a*) and the torsion coil spring 52*c* (62*c*) may be provided per each guide piece 52*b* (62*b*). That is, a plurality of change-over guides 52 (62) including one rotating shaft 52*a* (62*a*), one guide piece 52*b* (62*b*), and one torsion coil spring 52*c* (62*c*) may be provided. Still further, one or more change-over guides 52 (62), i.e., guide pieces 52*b* (62*b*) may be provided.

Still further, the case in which the present disclosure is applied to the color printer 1 as one example has been described in the present embodiment, the present disclosure is not limited to such case, and the present disclosure is applicable also to a monochrome printer, a facsimile, a multi-function printer, and the like.

While the preferable embodiment and its modified example of the sheet correcting device and the image forming apparatus or the like of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A curl correcting device, comprising:

a pair of fixed guides composing a curved part of a conveyance path through which a sheet is conveyed while being curved;

a change-over guide provided to be contactable with the sheet conveyed through the conveyance path from a radial outer side of the curved part; and a discharge roller pair configured to nip the sheet and configured to feed the sheet toward the conveyance path;

wherein the pair of fixed guides includes an outer guide at the radial outer side of the curved part, the outer guide comprising:

a pair of side pressing parts formed at both ends in a width direction orthogonal to a conveyance direction of the sheet; and a bulge part formed between the pair of side pressing parts so as to bulge toward the radial outer side of the curved part more than the pair of side pressing parts; and wherein the change-over guide comprises:

a rotating shaft provided downstream of the conveyance path extending so as to curve from a nip part of the discharge roller pair;

a guide piece configured to extend to the nip part from the rotating shaft and configured to be turnable centering on the rotating shaft; and a biasing member configured to bias the guide piece toward the first correcting position;

the change-over guide being configured to move to a first correcting position set within the bulge part in a case where the sheet curled along the conveyance direction is conveyed through the conveyance path and to move to a second correcting position set at the radial outer side of the curved part more than the first correcting position in a case where the sheet curled along the width direction is conveyed through the conveyance path.

2. The curl correcting device according to claim 1, wherein the guide piece displaced to the first correcting position is located at a radial inner side of the curved part more than the respective side pressing parts, and the guide piece displaced to the second correcting position is located at the radial outer side of the curved part more than the respective side pressing parts and at the radial inner side of the curved part more than the bulge part.

3. The curl correcting device according to claim 1, further comprising:

a detecting part configured to detect a condition of a curl of the sheet; and a driving part configured to move the change-over guide based on detection results of the detecting part.

4. The curl correcting device according to claim 3, further comprising a discharge roller pair configured to nip the sheet and configured to feed the sheet toward the conveyance path, wherein the change-over guide comprises:

a rotating shaft provided downstream of the conveyance path of a nip part of the discharge roller pair;

a guide piece configured to extend to downstream of the conveyance path from the rotating shaft and configured to be turnable centering on the rotating shaft; and an biasing member configured to bias the guide piece toward a second correcting position: and wherein the driving part presses the change-over guide toward the first correcting position.

5. The curl correcting device according to claim 3, wherein the driving part comprises:

a change-over cam fixed to a cam shaft disposed in parallel with the rotating shaft and configured to come in contact with a cam follower part provided on the cam shaft; and a cam motor connected with the cam shaft and rotates the change-over cam, and wherein the detecting part comprises:

three sheet detecting sensors disposed at the widthwise both end parts and the widthwise center part; and a detection control unit configured to control the cam motor based on detection results of the respective sheet detecting sensors.

6. The curl correcting device according to claim 1, wherein the change-over guide comprises a rotator rotating by coming in contact with the sheet.

7. The curl correcting device according to claim 1, wherein the change-over guide comprises a pair of guide pieces provided so as to be symmetrical with a widthwise center line.

8. An image forming apparatus comprising:

an image forming part configured to transfer a toner image onto a sheet to form an image;

a fixing unit configured to fix the toner image on the sheet;

a discharge tray composed as a discharge destination of the sheet which the toner image has been fixed; and a curl correcting device provided between the fixing unit and the discharge tray and configured to correct a curl of the sheet being conveyed toward the discharge tray;

wherein the curl correcting device comprises:

a pair of fixed guides composing a curved part of a conveyance path through which a sheet is conveyed while being curved;

a change-over guide provided to be contactable with the sheet conveyed through the conveyance path from a radial outer side of the curved part; and a discharge roller pair configured to nip the sheet and configured to feed the sheet toward the conveyance path;

wherein the pair of fixed guides includes an outer guide at the radial outer side of the curved part, the outer guide comprising:

a pair of side pressing parts formed at both ends in a width direction orthogonal to a conveyance direction of the sheet; and a bulge part formed between the pair of side pressing parts so as to bulge toward the radial outer side of the curved part more than the pair of side pressing parts; and wherein the change-over guide comprises:

a rotating shaft provided downstream of the conveyance path extending so as to curve from a nip part of the discharge roller pair;

a guide piece configured to extend to the nip part from the rotating shaft and configured to be turnable centering on the rotating shaft; and a biasing member configured to bias the guide piece toward the first correcting position;

the change-over guide being configured to move to a first correcting position set within the bulge part in a case where the sheet curled along the conveyance direction is conveyed through the conveyance path and to move to a second correcting position set at the radial outer side of the curved part more than the first correcting position in a case where the sheet curled along the width direction is conveyed through the conveyance path.

* * * * *